US006956531B2

(12) United States Patent
Sugiyama et al.

(10) Patent No.: US 6,956,531 B2
(45) Date of Patent: Oct. 18, 2005

(54) BUILT-IN ANTENNA AND MOBILE TERMINAL INCORPORATING SAME

(75) Inventors: Takahiro Sugiyama, Tokyo (JP); Shinichi Takaba, Tokyo (JP); Morihiko Ikegaya, Tokyo (JP); Shinichiro Suzuki, Tokyo (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 10/488,890

(22) PCT Filed: Jun. 18, 2003

(86) PCT No.: PCT/JP03/07746

§ 371 (c)(1),
(2), (4) Date: Mar. 8, 2004

(87) PCT Pub. No.: WO04/001901

PCT Pub. Date: Dec. 31, 2003

(65) Prior Publication Data

US 2005/0001772 A1 Jan. 6, 2005

(30) Foreign Application Priority Data

Jun. 19, 2002 (JP) ..... 2002-178376

(51) Int. Cl.[7] ..... H01Q 1/24
(52) U.S. Cl. ..... 343/702; 343/767
(58) Field of Search ..... 343/700 MS, 702, 343/767

(56) References Cited

U.S. PATENT DOCUMENTS 5,767,810 A 6/1998 Hagiwara et al. .... 343/700 MS
6,384,793 B2 * 5/2002 Scordilis ..... 343/767

FOREIGN PATENT DOCUMENTS

JP 2-252301 A 10/1990
JP 8-023220 A 1/1996
JP 2002-141724 A 5/2002
JP 2002-217637 A 8/2002

* cited by examiner

*Primary Examiner*—Shih-Chao Chen
(74) *Attorney, Agent, or Firm*—Foley & Lardner LLP

(57) ABSTRACT

A built-in antenna having: a support body that has a top surface shape having a flat plane that has three neighboring sides with two corners defined therebetween and inclined planes that extend downward from the respective three sides and has other planes between the inclined planes; and a metal conductor that is mounted on the support body, the metal conductor having a shape corresponding to the top surface shape of the support body, the shape being formed by bending a metal plate. The metal conductor has a first slit located corresponding to a middle side of the three sides and a second slit located extending downward from one of the two corners, the second slit being communicated with the first slit and having an opened end.

5 Claims, 5 Drawing Sheets

BUILT-IN ANTENNA AND MOBILE TERMINAL INCORPORATING SAME

The present application is based on Japanese patent application No. 2002-178376, the entire contents of which are incorporated herein by reference.

TECHNICAL FIELD

This invention relates to an antenna incorporated in device (herein referred to as built-in antenna) and a mobile terminal incorporating the same, and more particularly to a built-in antenna that a metal conductor with a polyhedral shape formed by bending is tightly fitted on a support body and a wide-band mobile terminal incorporating the same.

BACKGROUND ART

Conventionally, as an antenna for mobile apparatus in mobile communication, an external type antenna such as a rod antenna and a helical antenna is provided protruding from the housing of a mobile terminal.

However, the protruding antenna has drawbacks that it interferes with handling and is subjected to breakage. Moreover, it is not desirable from the aspect of design. Therefore, built-in antennas are apt to substitute for the external type antenna.

FIG. 1 shows the general composition of a mobile terminal (cellular phone) equipped with a built-in antenna. The cellular phone is composed of a printed-circuit board 101, a liquid crystal 102, an RF circuit 104 housed in a shield case 103 on the back of the board 101, an antenna 105 and a battery 106. These components are compactly housed in a housing 107.

As shown in this composition, the antenna 105 is generally incorporated at the upper portion of housing because its user holds the lower portion of housing 107 in phone call. Thus, the periphery of antenna 105 is kept not to be shielded with the hand of user and a good line for calling can be secured. The built-in antenna is able to solve all the drawbacks of external type antenna and to provide a cellular phone with good function and design.

FIG. 2 shows the general structure of built-in antenna 105. The built-in antenna 105 is composed of an insulative support body 108 with polyhedral portion formed on the top, and a metal conductor 109 that is formed by pressing and bending a copper plate etc. to have a shape to be tightly fitted on the support body 108. These are integrated using an adhesive agent etc. 110 is a slit formed in the metal conductor 109 to adjust the resonance frequency, 111 is a feeder terminal and 112 is a ground terminal.

By the way, it is required that the metal conductor 109 has a volume as much as possible to secure a wider band characteristic since there is a problem that built-in antennas have a band characteristic narrower than external type antennas. Therefore, the shape is made to be polyhedral rather than flat plane. Namely, as shown in FIG. 2, the top of support body 108 is composed of a flat plane 113 and inclined planes 114, 115 extending downward from the flat plane 113, and the metal conductor 109 is formed into a shape to be fitted thereto by bending. The metal conductor 109 thus formed has a volume greater than that of flat plate type, and the band characteristic thereof is enlarged by that much.

FIG. 3 shows a built-in antenna that is suggested to have a further enlarged band characteristic.

The built-in antenna in FIG. 3 is composed such that the support body 108 and metal conductor 109 shown in FIG. 2 are extended as shown by double-dashed chain lines in FIG. 3. Surfaces (116) to (118) are added both to the support body 108 and metal conductor 109 and, therefore, the volume of metal conductor 109 is further increased to further enlarge the band characteristic. The feeder terminal 111 and ground terminal 112 are, of course, provided on the surface (117).

The polyhedral shape thus formed is desirable not only for enhancement in antenna property but also for housing easily the antenna in the upper portion of housing 107 that is formed, as shown in FIG. 1, tapered to meet the demand of design. Thus, the built-in antenna thus composed offers a good utility to various mobile terminals such as a cellular phone.

However, in the built-in antenna shown in FIG. 3, it is difficult to form the four surfaces (117), (118), 119 and 120 of metal conductor 109 by bending without having any strain at, e.g., the corner A of flat plane 113. Therefore, when the metal conductor 109 is mounted on the support body 108, excessive part of copper plate to be generated by bending may form uneven region at particularly bended portions among the surfaces (117), (118), 119 and 120. Such an uneven region may be also formed at the opposite corner B.

As a result, there may occur a deviation in band characteristic between devices due to the uneven region formed in the vicinity of the bended portions of metal conductor 109. Further, when mounting the metal conductor 109 on the support body 108, there may occur a gap in the vicinity of bended portions. Therefore, the metal conductor 109 may be not stably held by the support body and, therefore, the band characteristic may be affected adversely.

DISCLOSURE OF INVENTION

It is an object of the invention to provide a built-in antenna with stable band characteristic as well as wide band characteristic and a wide band characteristic mobile terminal equipped with the built-in antenna.

According to first aspect of the invention, a built-in antenna, comprises:

a support body that has a top surface shape composed of a flat plane that has three neighboring sides with two corners defined therebetween and inclined planes that extend downward from the respective three sides and include other planes between the inclined planes; and a metal conductor that is mounted on the support body, the metal conductor having a shape corresponding to the top surface shape of the support body, the shape being formed by bending a metal plate;

wherein the metal conductor includes a first slit located corresponding to a middle side of the three sides and a second slit located extending downward from one of the two corners, the second slit being communicated with the first slit and having an opened end.

According to second aspect of the invention, a mobile terminal, comprises:

an antenna that is housed in the mobile terminal and is composed of a support body and a metal conductor with a predetermined shape to be mounted on the support body;

wherein the antenna is composed of the support body that has a top surface shape composed of a flat plane that has three neighboring sides with two corners defined therebetween and inclined planes that extend downward from the respective three sides and include other planes between the inclined planes, and the metal conductor that is mounted on the support body, the metal conductor having a shape corresponding to the top surface shape of the support body, the shape being formed by bending a metal plate, and the metal conductor includes a first slit located corresponding to a middle side of the three sides and a second slit located extending downward from one of the two corners, the second slit being communicated with the first slit and having an opened end.

According to third aspect of the invention, a built-in antenna, comprises:

a support body that has a top surface shape composed of a polygonal flat plane, three first inclined planes that extend inclining downward from three neighboring sides of sides to define the flat plane, and at least two second inclined planes to connect between each pair of the three first inclined planes; and a metal conductor that is mounted on the support body, the metal conductor having a shape corresponding to the top surface shape of the support body, the shape being formed by bending a metal plate;

wherein the metal conductor includes a slit that is formed by cutting so as to expose the periphery of a corner surrounded by the flat plane, neighboring two of the first inclined planes and the second inclined plane to connect between the neighboring two of the first inclined planes.

In the built-in antenna described above, it is preferred that the top surface of support body and the metal conductor have a composition described below.

Namely, it is preferred that the top surface of the support body and the metal conductor include the flat plane of rectangular form, first inclined planes extending downward from the respective three sides and two second inclined planes located at the respective two corners, the second inclined planes connecting between the first inclined planes, such that the top surface of the support body and the metal conductor are shaped to be fitted to each other; and the metal conductor has the second slit between one end of the first inclined plane extending downward from the middle side of the three sides and one of the second inclined planes. This is an optimum composition when the antenna shown in FIG. 3 is composed applying the invention.

Also, it is preferred that the first and second slits are shaped by pressing such that they have a width that gradually increases from a base portion of the first slit to the opened end of the second slit. By thus pressing, the width of slit can be kept constant that is likely to narrow in the direction of the opened end in the process of bending.

The metal plate to compose the metal conductor may be a copper plate or phosphor bronze plate. The material of support body may be various plastics such as ABS resin and carbonate resin.

BRIEF DESCRIPTION OF DRAWINGS

The preferred embodiments according to the invention will be explained below referring to the attached drawings, wherein.

BEST MODE FOR CARRYING OUT THE INVENTION

The preferred embodiments of the invention are explained below with reference to the attached drawings.

Figure 4:
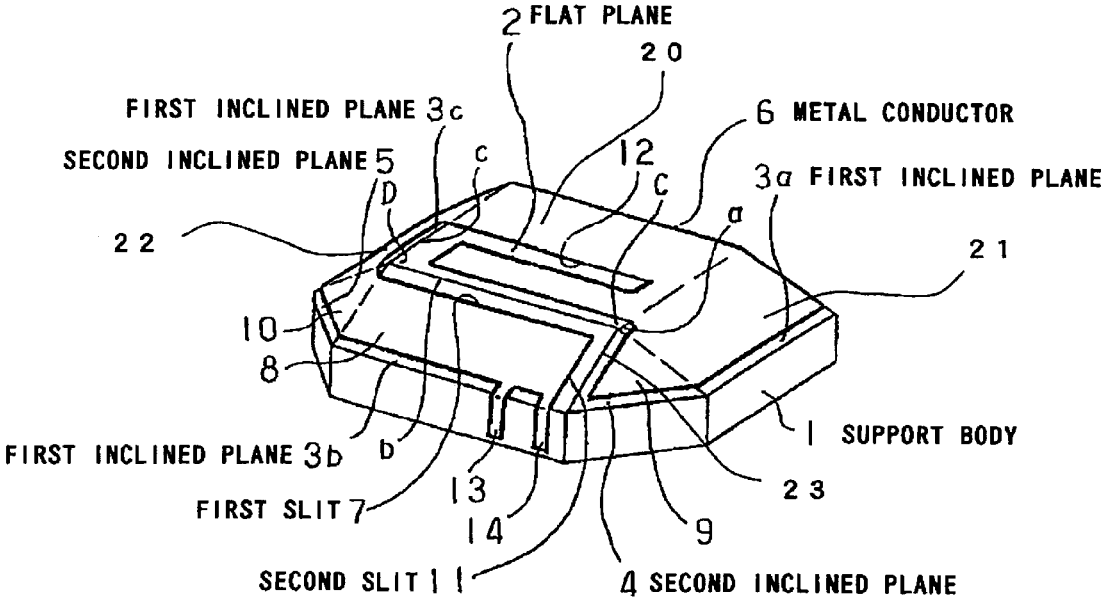
FIG. 4 shows a built-in antenna in a preferred embodiment according to the invention.

In FIG. 4, 1 indicates a support body, and the upper part of support body 1 is composed of a rectangular flat plane 2, first inclined planes 3*a*, 3*b* and 3*c* that are formed inclining downward from three sides a, b and c of four sides defining the flat plane 2 while having two neighboring corners C, D therebetween, and second inclined planes 4, 5 which respectively connect between the first inclined planes 3*a*, 3*b* and between the first inclined planes 3*b*, 3*c*.

6 indicates a metal conductor that is made by pressing and bending a copper plate. The metal conductor 6 has a polyhedral shape to be fitted to the shape of upper portion of support body 1. It is attached on the support body 1 to be integrally contacted thereto.

As shown in FIG. 4, the metal conductor 6 is composed of a flat plane 20 that is defined on the flat plane 2 of support body 1 while having a slit 12, an inclined plane 21 that is defined by being bent along the first inclined plane 3*a* of support body 1 while connecting with the flat plane 20, an inclined plane 9 that is defined by being bent along the second inclined plane 4 of support body 1 while connecting with the inclined plane 21, an inclined plane 22 that is defined by being bent along the first inclined plane 3*c* of support body 1 while connecting with the flat plane 20, an inclined plane 10 that is defined by being bent along the second inclined plane 5 of support body 1 while connecting with the inclined plane 22, and an inclined plane 8 that is defined by being bent along the first inclined plane 3*b* of support body 1 while connecting with the inclined plane 10. The slit 12 extends on the first inclined plane 3*c* and extends along the side c to the corner D of support body 1.

The metal conductor 6 is further composed of a first slit 7 that extends along the side b defining the flat plane 2 of support body 1 while exposing the side b, corner D and the periphery thereof, and a second slit 11 that extends along a ridge line 23 between the first inclined plane 3*b* and the second inclined plane 4 of support body 1 while exposing the ridge line 23, corner C and the periphery thereof. The second slit 11 is formed such that it connects with the first slit 7 at the one end and has an opening at the other end.

Meanwhile, the slit 12 is formed to adjust the resonance frequency and, in this embodiment, part thereof is shared with the first and second slits 7, 11. 13 indicates a feeder terminal formed at the lower end of the inclined plane 8 of metal conductor 6 being located on the first inclined plane 3*b*, and 14 indicates a ground terminal.

In the built-in antenna of the embodiment thus composed, the first slit 7 and second slit 11 formed in the metal conductor 6 serve to eliminate or absorb excessive part of copper plate to be generated by bending. Therefore, the metal conductor 6 can be tightly fitted to the support body 1 without incurring any gap although it has a polyhedral shape.

Figure 1:
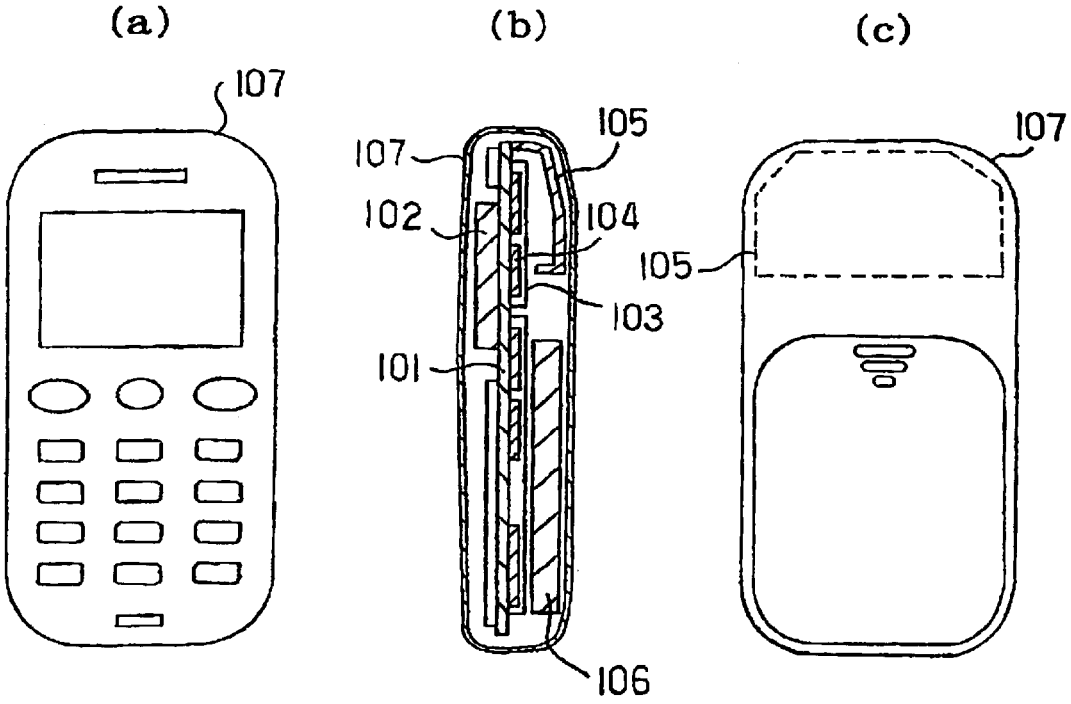
FIG. 1 (PRIOR ART)
FIGS. 1(*a*) to (*c*) are front, side and back views showing a cellular phone equipped with the conventional built-in antenna.
Figure 2:
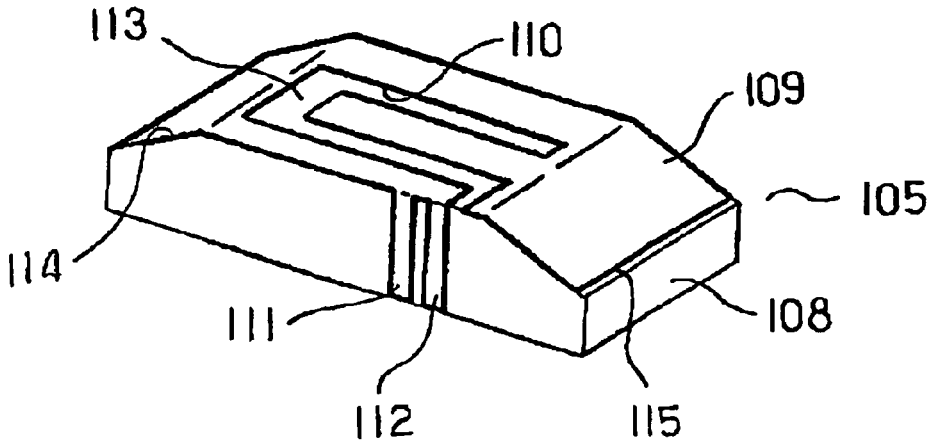
FIG.2 (PRIOR ART)
FIG. 2 shows the conventional built-in antenna.
Figure 3:
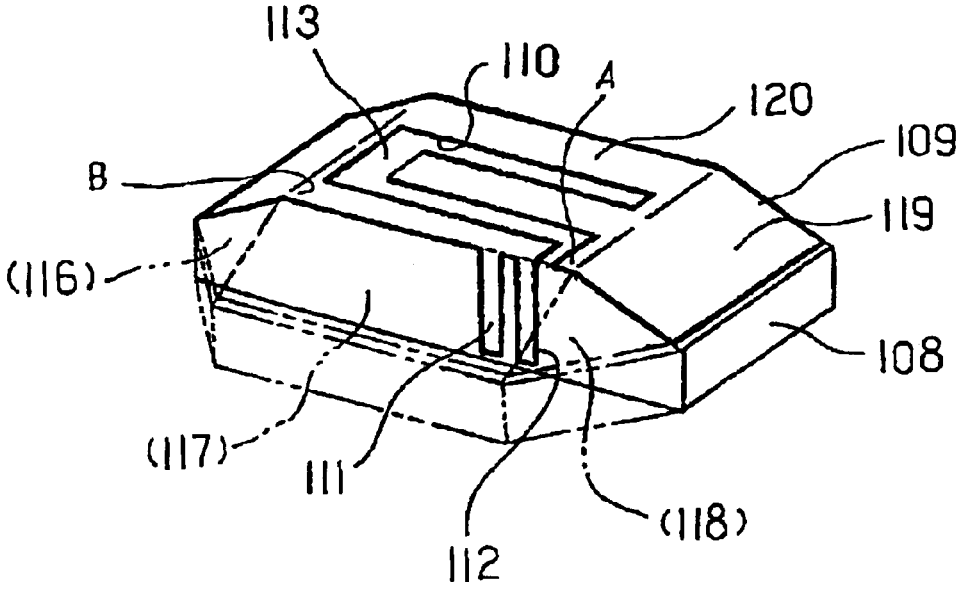
FIG.3 (PRIOR ART)
FIG. 3 shows the suggested built-in antenna with further enlarged band characteristic.

A mobile terminal incorporating the built-in antenna is, of course, provided with a good wide band characteristic based on the antenna with polyhedral shape. Furthermore, when the built-in antenna is formed as shown in FIG. 4, the antenna can be easily housed in the tapered top portion of housing 107 as shown in FIG. 1 to give the cellular phone a good design.

Although in this embodiment the first inclined planes 3*a*, 3*b* and 3*c* and the second inclined planes 4, 5 are formed only on one side, these maybe added on the opposite side if necessary. Also, the flat plane 2 may be formed polygonal other than rectangular and, in that case, the number of first and second inclined planes may be changed corresponding to that.

Figure 5:
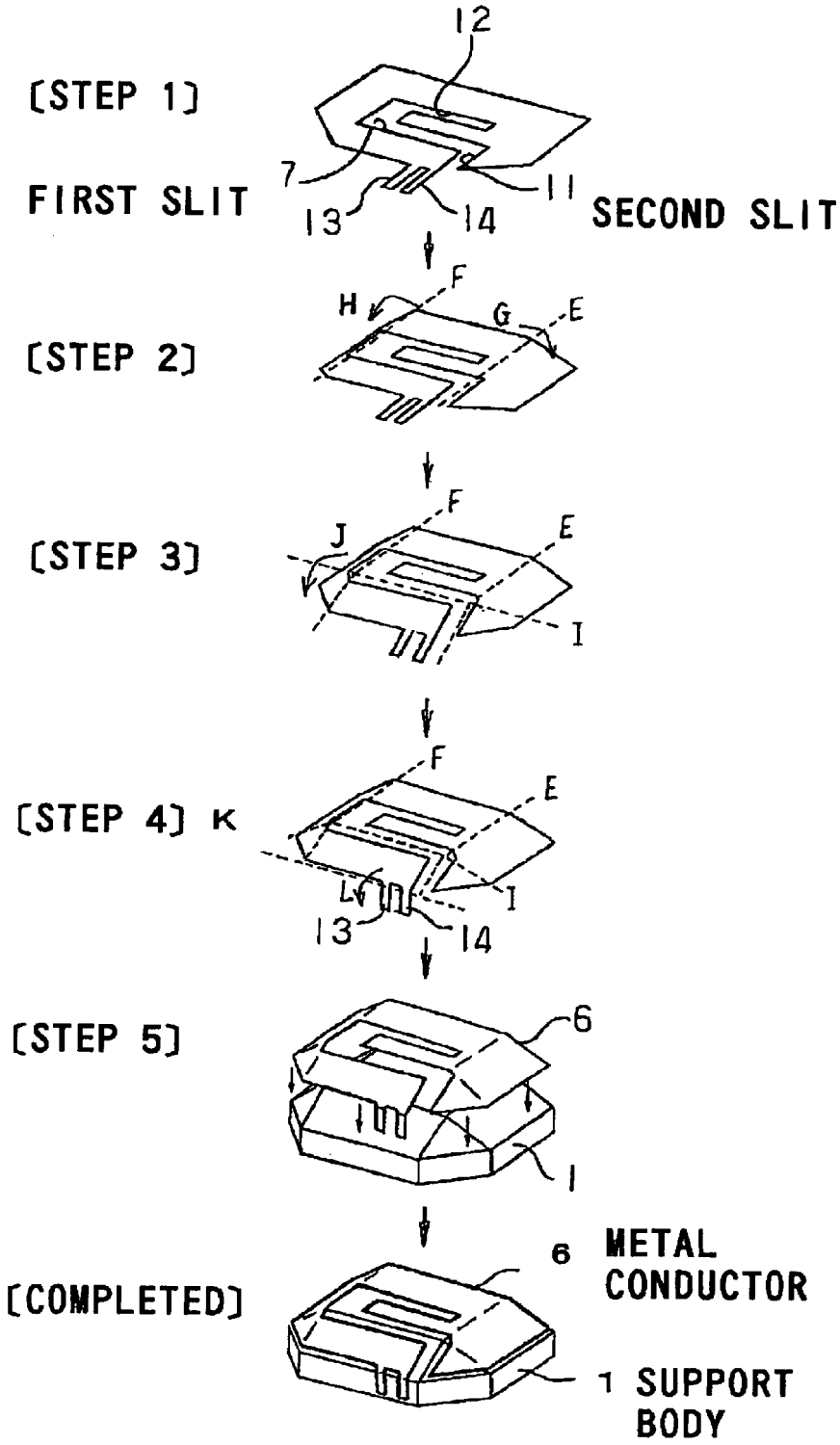
FIG. 5 shows a method of making the built-in antenna shown in FIG. 4.

FIG. 5 shows a method of making the built-in antenna shown in FIG. 4. Step 1 shows the composition of copper plate before bending. The copper plate is formed by pressing into such a given shape that has the slit 12 including the first slit 7 and second slit 11, the feeder terminal 13 and ground terminal 14.

Then, in step 2, the copper plate is bent a predetermined angle at fold lines E, F in the direction of arrows G, H. Further, in step. 3, it is bent a predetermined angle at a fold line I, which runs through the first slit 7 while lying perpendicular to the fold lines E, F, in the direction of an arrow J. Then, in step 4, the terminals 13, 14 are bent a predetermined angle at a fold line K in the direction of an arrow L.

In step 5, the metal conductor 6 thus shaped by bending is then integrally attached on the support body 1 by using a given means. Thus, as shown by "completed" in FIG. 5 (or as show in FIG. 4), the built-in antenna with the predetermined polyhedral shape can be obtained.

In the process shown in FIG. 5, the copper plate after pressing is formed into the metal conductor 6 only by bending. Therefore, the polyhedral antenna can be made at an advantageously lowcost. This is brought by that the first slit 7 and second slit 11 of the metal conductor 6 are formed corresponding to the top shape of support body 1 that has the inclined planes 3*a*, 4 and 3*b* and the inclined planes 3*b*, 5 and 3*c* formed in the periphery of the corners C and D, respectively, of flat plane 2.

Figure 6:
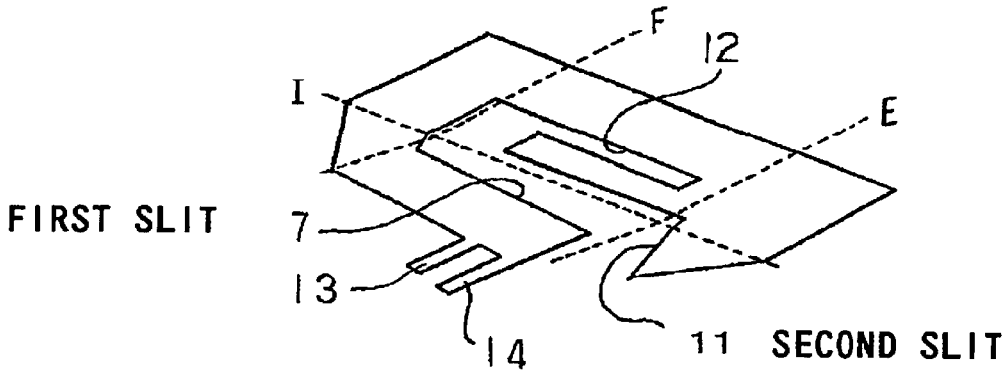
FIG. 6 shows a modification of the method shown in FIG. 5.

FIG.6 shows the modified form of copper plate after pressing available in the process in FIG. 5. The difference from that in FIG. 5 is that the width of first slit 7 and second slit 11 is gradually increased in the direction of from the base portion of first slit 7 to the opened end of second slit 11.

By thus forming the width of slits 7, 11, the width of slit 7, 11 can be kept constant that is likely to narrow in the direction of the opened end of second slit 11 in the process of bending. Such a pressing technique is practical and employed in many cases.

INDUSTRIAL APPLICABILITY

According to the invention, there are provided a built-in antenna with stable band characteristic as well as wide band characteristic and a wide band characteristic mobile terminal equipped with the built-in antenna.

What is claimed is:

1. A built-in antenna, comprising:

a support body that has a top surface shape composed of a flat plane that has three neighboring sides with two corners defined therebetween and inclined planes that extend downward from the respective three sides and include other planes between the inclined planes; and a metal conductor that is mounted on the support body, the metal conductor having a shape corresponding to the top surface shape of the support body, the shape being formed by bending a metal plate;

wherein the metal conductor includes a first slit located corresponding to a middle side of the three sides and a second slit located extending downward from one of the two corners, the second slit being communicated with the first slit and having an opened end.

2. The built-in antenna according to claim 1, wherein:

the lop surface of the support body and the metal conductor include the flat plane of rectangular form, first inclined planes extending downward from the respective three sides and two second inclined planes located at the respective two corners, the second inclined planes connecting between the first inclined planes, such that the top surface of the support body and the metal conductor are shaped to be fitted to each other; and the metal conductor has the second slit between one end of the first inclined plane extending downward from the middle side of the three sides and one of the second inclined planes.

3. The built-in antenna according to claim 1, wherein:

the metal conductor is formed by bending the metal plate being shaped by pressing such that the first and second slits have a width that gradually increases from one end of the first slit where the first slit is not connected with the second slit to the opened end of the second slit.

4. A mobile terminal, comprising:

an antenna that is housed in the mobile terminal and is composed of a support body and a metal conductor with a predetermined shape to be mounted on the support body;

wherein the antenna is composed of the support body that has a top surface shape composed of a flat plane that has three neighboring sides with two corners defined therebetween and inclined planes that extend downward from the respective three sides and include other planes between the inclined planes, and the metal conductor that is mounted on the support body, the metal conductor having a shape corresponding to the top surface shape of the support body, the shape being formed by bending a metal plate, and the metal conductor includes a first slit located corresponding to a middle side of the three sides and a second slit located extending downward from one of the two corners, the second slit being communicated with the first slit and having an opened end.

5. A built-in antenna, comprising:

a support body that has a top surface shape composed of a polygonal flat plane, three first inclined planes that extend inclining downward from three neighboring sides of sides to define the flat plane, and at least two second inclined planes to connect between each pair of the three first inclined planes; and a metal conductor that is mounted on the support body, the metal conductor having a shape corresponding to the top surface shape of the support body, the shape being formed by bending a metal plate;

wherein the metal conductor includes a slit that is formed by cutting so as to expose the periphery of a corner surrounded by the flat plane, neighboring two of the first inclined planes and the second inclined plane to connect between the neighboring two of the first inclined planes.

* * * * *